US005265921A

United States Patent [19]

Nikitas et al.

[11] Patent Number: 5,265,921

[45] Date of Patent: Nov. 30, 1993

[54] REFRIGERATOR LOCK APPARATUS

[76] Inventors: John P. Nikitas, 9 Zilber Ct., Hampton, Va. 23669; Robert D. Anderson, 378 Rivers Ridge Cir., Newport News, Va. 23602

[21] Appl. No.: 36,547

[22] Filed: Mar. 24, 1993

[51] Int. Cl.[5] ..... E05C 1/04; E05C 3/04

[52] U.S. Cl. ..... 292/145; 292/DIG. 28; 292/DIG. 53; 292/DIG. 71:202

[58] Field of Search ..... 292/145, 65, 137, 142, 292/DIG. 28, DIG. 53, DIG. 71, DIG. 65, 194, 202

[56] References Cited

U.S. PATENT DOCUMENTS 884,003 4/1908 Barton ..... 292/145 X
1,354,646 10/1920 Heintzelman ..... 292/147
1,645,229 10/1927 Churmusi ..... 292/DIG. 28 X
1,776,580 9/1930 Deasy ..... 292/145
4,469,358 9/1981 Abbott ..... 292/DIG. 65 X
4,648,637 3/1987 Walter ..... 242/DIG. 71 X
5,114,194 5/1992 Toifl et al. ..... 292/DIG. 28 X

*Primary Examiner*—Richard E. Moore
*Attorney, Agent, or Firm*—Leon Gilden

[57] ABSTRACT

A child-resistant lock structure includes cooperative first and second plates arranged for adjacency relative to one another mounted to a respective refrigerator and refrigerator door, wherein a first mounting plate is arranged to receive a latch bolt from a second mounting plate in communication relative to one another, with the first and second plates having first and second suction cups arranged for ease of securement of the lock structure without damage to the refrigerator surface.

6 Claims, 4 Drawing Sheets

REFRIGERATOR LOCK APPARATUS

BACKGROUND OF THE INVENTION

1. Field of the Invention

The field of invention relates to lock apparatus, and more particularly pertains to a new and improved refrigerator lock apparatus arranged to deter access to an associated refrigerator by children and the like.

2. Description of the Prior Art

Lock structure and lock structure directed to refrigerator latching is indicated in U.S. Pat. No. 4,503,582 wherein a sliding lock bolt arrangement is arranged to secure a refrigerator door in a closed orientation.

U.S. Pat. Nos. 4,132,440 and 3,626,712 are further examples of refrigerator latch apparatus.

The instant invention attempts to overcome deficiencies of the prior art by providing for refrigerator latch structure arranged for ease of mounting and removal relative to a refrigerator door to avoid damage to the refrigerator door surface and in this respect, the present invention substantially fulfills this need.

SUMMARY OF THE INVENTION

In view of the foregoing disadvantages inherent in the known types of latch apparatus now present in the prior art, the present invention provides a refrigerator lock apparatus wherein the same is directed to the ease of mounting and removal relative to a refrigerator housing and door structure. As such, the general purpose of the present invention, which will be described subsequently in greater detail, is to provide a new and improved refrigerator lock apparatus which has all the advantages of the prior art refrigerator lock apparatus and none of the disadvantages.

To attain this, the present invention provides a child-resistant lock structure including cooperative first and second plates arranged for adjacency relative to one another mounted to a respective refrigerator and refrigerator door, wherein a first mounting plate is arranged to receive a latch bolt from a second mounting plate in communication relative to one another, with the first and second plates having first and second suction cups arranged for ease of securement of the lock structure without damage to the refrigerator surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved refrigerator lock apparatus which has all the advantages of the prior art refrigerator lock apparatus and none of the disadvantages.

It is another object of the present invention to provide a new and improved refrigerator lock apparatus which may be easily and efficiently manufactured and marketed.

It is a further object of the present invention to provide a new and improved refrigerator lock apparatus which is of a durable and reliable construction.

An even further object of the present invention is to provide a new and improved refrigerator lock apparatus which is susceptible of a low cost of manufacture with regard to both materials and labor, and which accordingly is then susceptible of low prices of sale to the consuming public, thereby making such refrigerator lock apparatus economically available to the buying public.

Still yet another object of the present invention is to provide a new and improved refrigerator lock apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
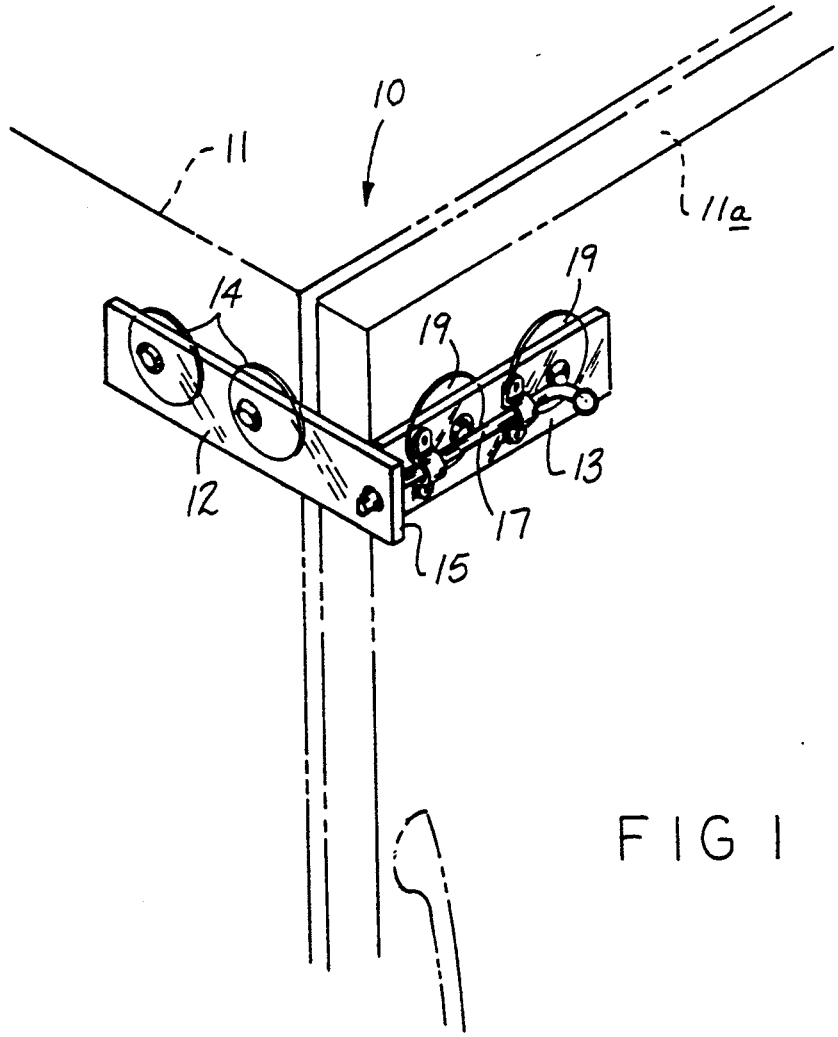
FIG. 1 is an isometric illustration of the invention.
Figure 2:
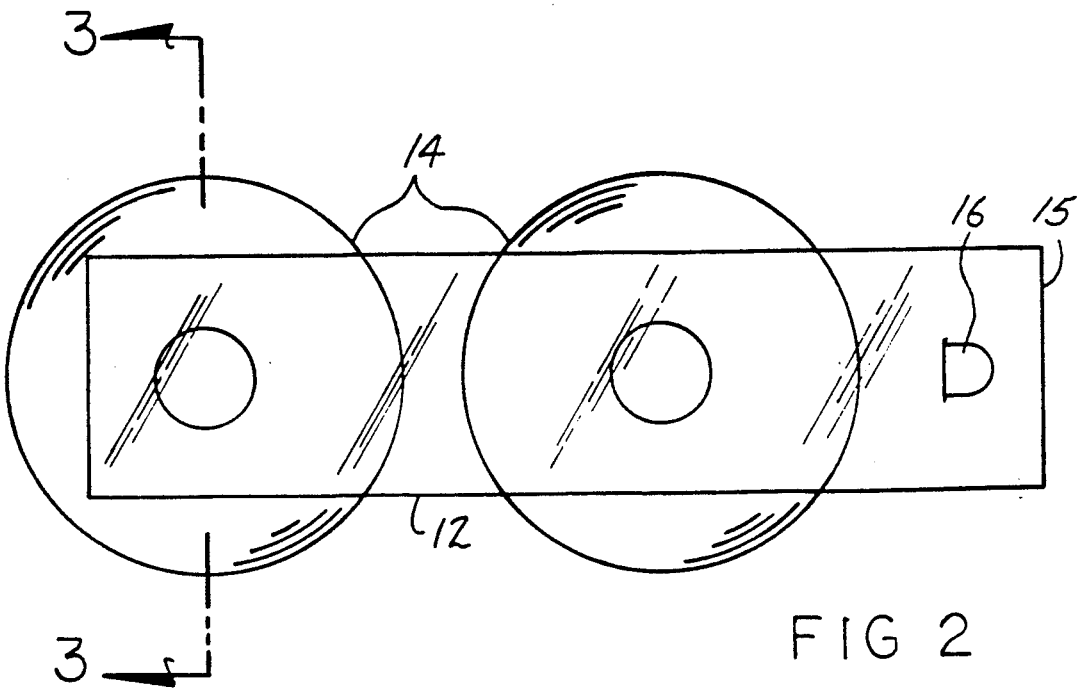
FIG. 2 is an orthographic view of the first mounting plate structure.
Figure 3:
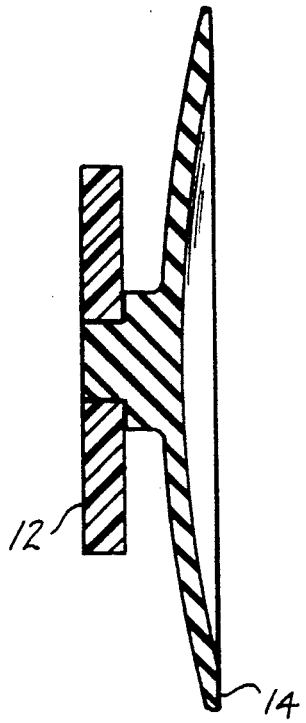
FIG. 3 is an orthographic view, taken along the lines 3—3 of FIG. 2 in the direction indicated by the arrows.
Figure 4:
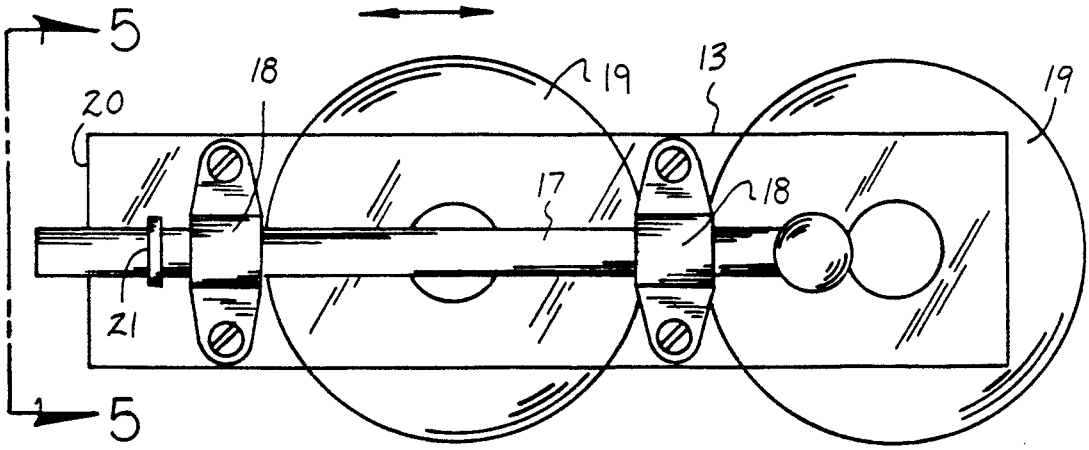
FIG. 4 is an orthographic view of the second mounting plate.
Figure 5:
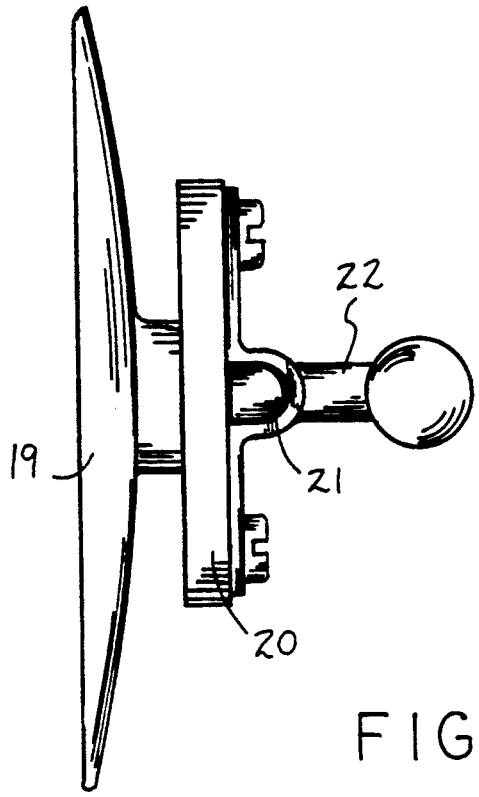
FIG. 5 is an orthographic view, taken along the lines 5—5 of FIG. 4 in the direction indicated by the arrows.
Figure 6:
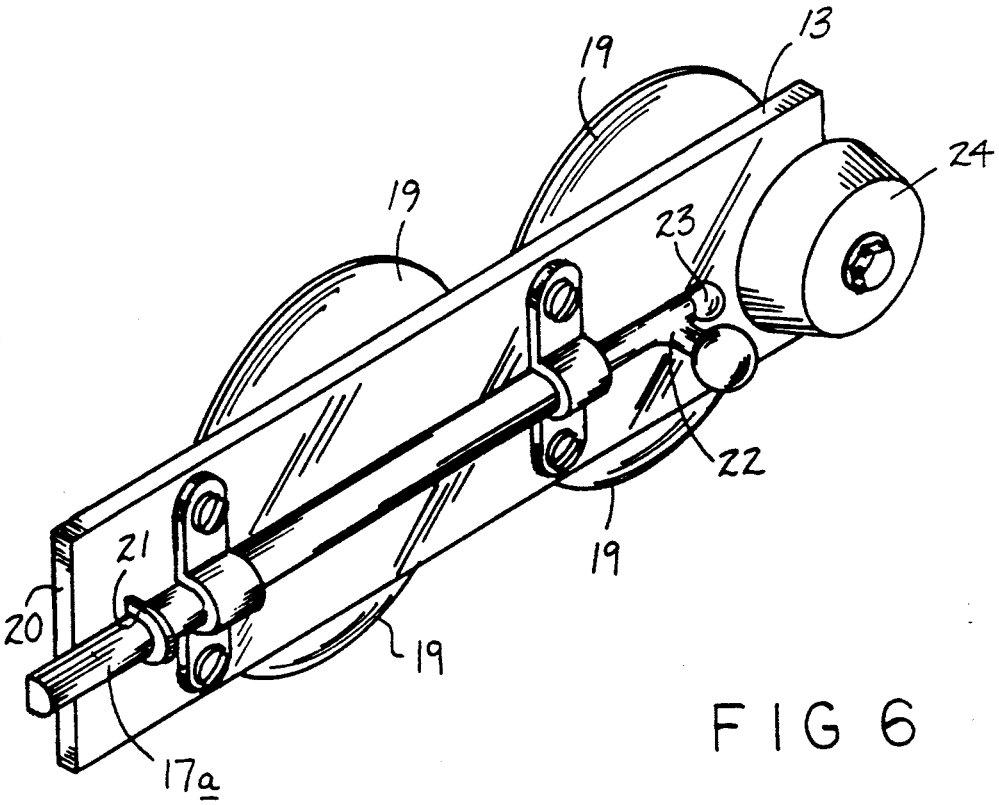
FIG. 6 is an isometric illustration of the second mounting plate including an audible signal member.

With reference now to the drawings, and in particular to FIGS. 1 to 8 thereof, a new and improved refrigerator lock apparatus embodying the principles and concepts of the present invention and generally designated by the reference numerals 10, 10*a*, and 10*b* will be described.

More specifically, the refrigerator lock apparatus 10 of the instant invention essentially comprises mounting to a refrigerator 11, having a refrigerator door 11*a* hingedly mounted thereto in a conventional manner.

A first rigid mounting plate 12 of planar construction is arranged in a secured orientation relative to the refrigerator 11 in an orthogonal orientation relative to a second rigid mounting plate 13, also of generally planar construction. First plate suction cups 14 mounted to the first plate 12 secure the first plate relative to the refrigerator 11, wherein second plate suction cups 19 mounted to the second plate 13 secure the second mounting plate 13 to the refrigerator door 11*a*. A first plate aperture 16 is directed through the first plate in adjacency to the first plate forward end 15 to receive a forwardmost end of a slide bolt 17 slidably mounted within spaced parallel guide loops 18 mounted to the second plate 13. The slide bolt 17 includes a slide bolt abutment collar 21 mounted to the slide bolt between an outermost one of the guide loops 18 and the second plate forward end 20 to provide engagement with the first plate when the slide bolt forward end is received through the aperture 16. A slide bolt handle 22 is oriented in a protruding orientation relative to the slide bolt and to the second mounting plate at a second end of the slide bolt, wherein the FIG. 6 indicates the use of a modified slide bolt 17*a* having the handle positioned in adjacency relative to the second end of the slide bolt, wherein a slide bolt second end lug 23 protrudes beyond the handle for selective engagement with an audible bell 24 mounted to the second plate adjacent the second plate rearward end, whereupon retraction of the slide bolt relative to the first plate effects engagement of the slide bolt second end lug 23 with the bell 24 to provide for audible indication of separation of the slide bolt relative to the first plate to alert a parent and the like of a child's potential access to the associated refrigerator 11.

Figure 7:
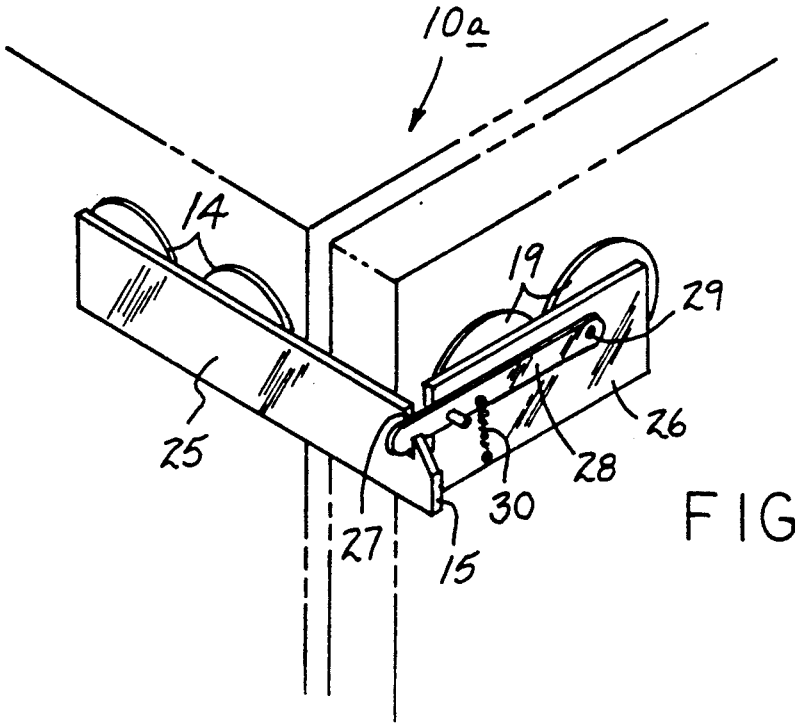
FIG. 7 is an isometric illustration of a further modified aspect of the invention.

The FIG. 7 indicates the apparatus 10*a* having a modified first plate 25 cooperative with a modified second plate 26, wherein the second plate 26 includes a latch leg 28 arranged for reception within a notch 27 of the first plate adjacent the first plate forward end 15, wherein the latch leg is pivotal about a pivot axle 29, with a spring 30 extending between the latch leg 28 and the mounting plate 26 to maintain biased communication of the latch leg within the notch 27 preventing inadvertent and unauthorized opening of the refrigerator door.

Figure 8:
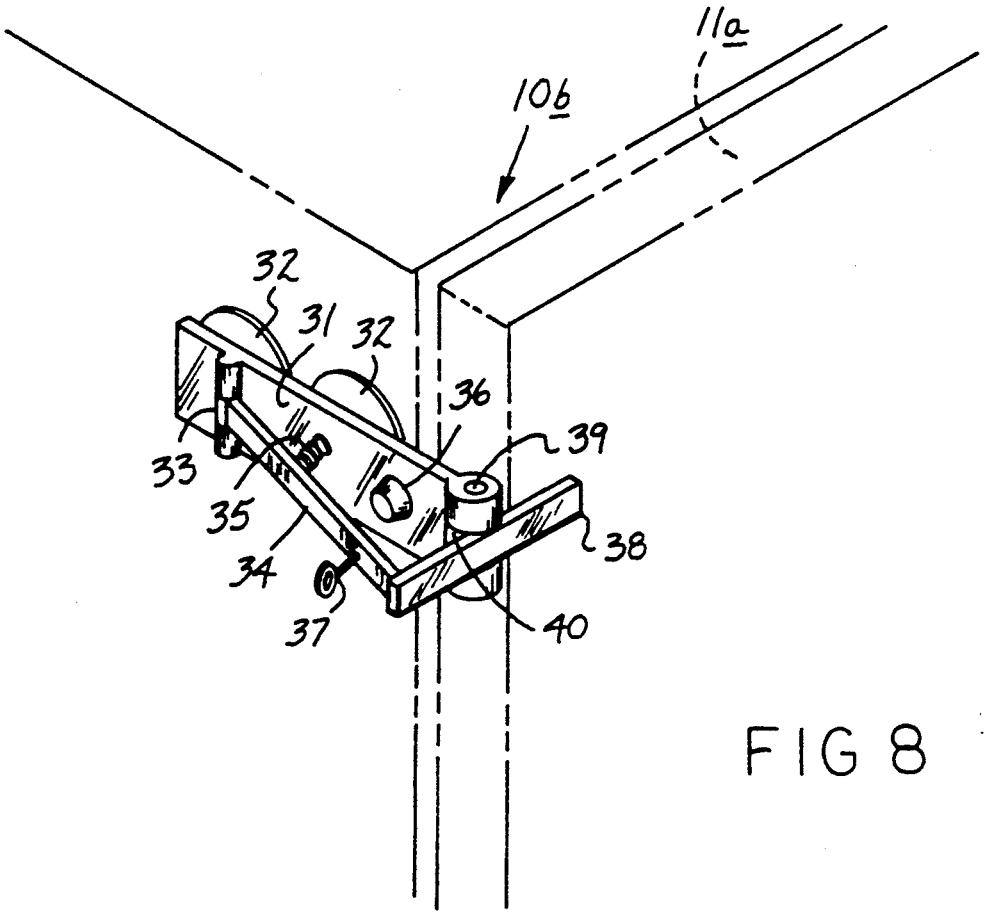
FIG. 8 is an isometric illustration of a yet further modified aspect of the invention.

The FIG. 8 indicates a further modified apparatus 10*b* having a primary mounting plate 31, including the mounting plate suction cup members 32 to secure the mounting plate to the refrigerator 11 in the aforenoted manner. A hinge 33 mounted to the mounting plate 31 includes a hinge leg 34 extending from the hinge 33, with a hinge leg spring 35 interposed between the hinge leg 34 and the primary mounting plate 31 to maintain engagement of the hinge leg 34 with a bumper pad 36 mounted to the mounting plate 31. A handle leg 37 provides for ease of grasping and separation of the hinge leg 34 relative to the bumper pad 36, wherein an abutment bar 38 is slidably received over a forward end notch 40 of the primary mounting plate forward end, with a roller 39 arranged for coextensive mounting through the primary mounting plate forward end, with the hinge leg 34 rotatably engaging the roller 39, whereupon in a normally biased orientation, the abutment bar 38 is directed over the refrigerator door 11*a* to prevent its unauthorized opening.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A refrigerator lock apparatus, comprising, a first rigid planar mounting plate orthogonally oriented relative to a second rigid mounting plate, wherein the first mounting plate includes a plurality of first plate suction cups mounted to the first mounting plate for securement to a refrigerator housing, wherein the second mounting plate includes a plurality of second plate suction cups secured to the second mounting plate and projecting from the second mounting plate for securement to a refrigerator door, the first mounting plate including a first plate forward end, and a first plate aperture directed through the first plate in adjacency to the first plate forward end, and a slide bolt, a plurality of guide loops mounted to the second mounting plate receiving the slide bolt therewithin, wherein the slide bolt is arranged for contiguous and sliding engagement with the second mounting plate, the slide bolt having a slide bolt forward end and a slide bolt rear end, the slide bolt rear end including a handle.

2. An apparatus as set forth in claim 1 wherein the second mounting plate includes a second mounting plate forward end and a second mounting plate rear end, with the slide bolt having a slide bolt abutment collar mounted about the slide bolt in adjacency to the slide bolt forward end spaced between the second plate forward end and one of said guide loops.

3. An apparatus as set forth in claim 2 wherein the slide bolt rear end includes a slide bolt lug, and a bell member mounted to the second mounting plate for engagement with the lug upon sliding projection of the slide bolt towards the second plate rear end.

4. A refrigerator lock apparatus, comprising, a mounting plate, the mounting plate including a plate first side and a plate second side, the plate first side including a plurality of suction cup members mounted thereon for securement to the refrigerator, the plate second side having a hinge mounted to the second side intermediate the mounting plate first end and the mounting plate second end, with a hinge leg pivotally mounted to the hinge, the hinge leg including an abutment bar fixedly and orthogonally mounted to the hinge leg spaced from the hinge, and the abutment bar arranged for sliding engagement with the mounting plate second end.

5. An apparatus as set forth in claim 4 wherein the mounting plate second end includes a roller member coextensive with the mounting plate second end, and a notch, with the roller arranged within the notch in sliding engagement with the abutment bar.

6. An apparatus as set forth in claim 5 including a handle leg fixedly mounted to the hinge leg intermediate the hinge and the roller, and a spring member mounted to the hinge leg and to the mounting plate to bias the hinge leg to the mounting plate, with a bumper pad secured to the mounting plate second side for engagement with the hinge leg.

* * * * *